US005382102A

United States Patent [19]

Brolund et al.

[11] Patent Number: 5,382,102

[45] Date of Patent: Jan. 17, 1995

[54] INDEXABLE MARKING TOOL FOR USE WITH A PUNCH PRESS

[75] Inventors: Theodore F. Brolund; Alfred J. Julian, both of Rockford, Ill.

[73] Assignee: W. A. Whitney Co., Rockford, Ill.

[21] Appl. No.: 127,940

[22] Filed: Sep. 28, 1993

[51] Int. Cl.[6] ..... B41J 1/54

[52] U.S. Cl. ..... 400/134; 101/3.1; 72/414; 83/552

[58] Field of Search ..... 101/3.1, 4, 18, 21, 101/29, 31; 400/127, 129, 130, 131, 132, 134, 134.2, 134.3, 141, 141.1, 142, 148; 72/414, 442, 446, 434; 83/552, 698

[56] References Cited

U.S. PATENT DOCUMENTS 4,569,267 2/1986 Klingel ..... 83/552

5,048,385 9/1991 Eckert et al. ..... 83/552

5,062,337 11/1991 Johnson et al. ..... 83/552

5,072,620 12/1991 Hill et al. ..... 72/414

5,201,589 4/1993 Chun et al. ..... 400/134

*Primary Examiner*—Ren Yan

*Attorney, Agent, or Firm*—Leydig, Voit & Mayer

[57] ABSTRACT

A marking tool assembly includes a plurality of marking punches for stamping alpha/numeric indicia into a workpiece. The punches are adapted to be indexed selectively to an active punching position beneath a striker which causes one of the punches to stamp the workpiece during the downstroke of the tool, the remaining punches resting idly on the workpiece. A stripper ring holds the striker rotationally stationary and also prevents rotation of a retaining ring for permitting up and down sliding of the punches in a holder and for guiding the punches to the active punching position.

7 Claims, 3 Drawing Sheets

FIG. 2
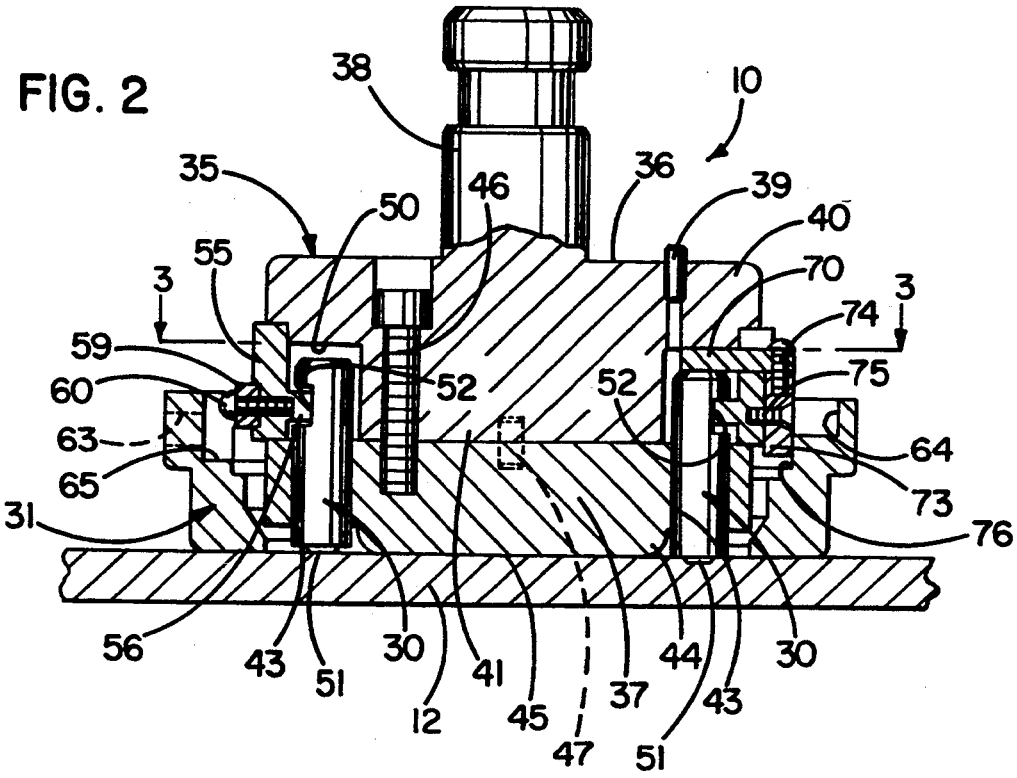
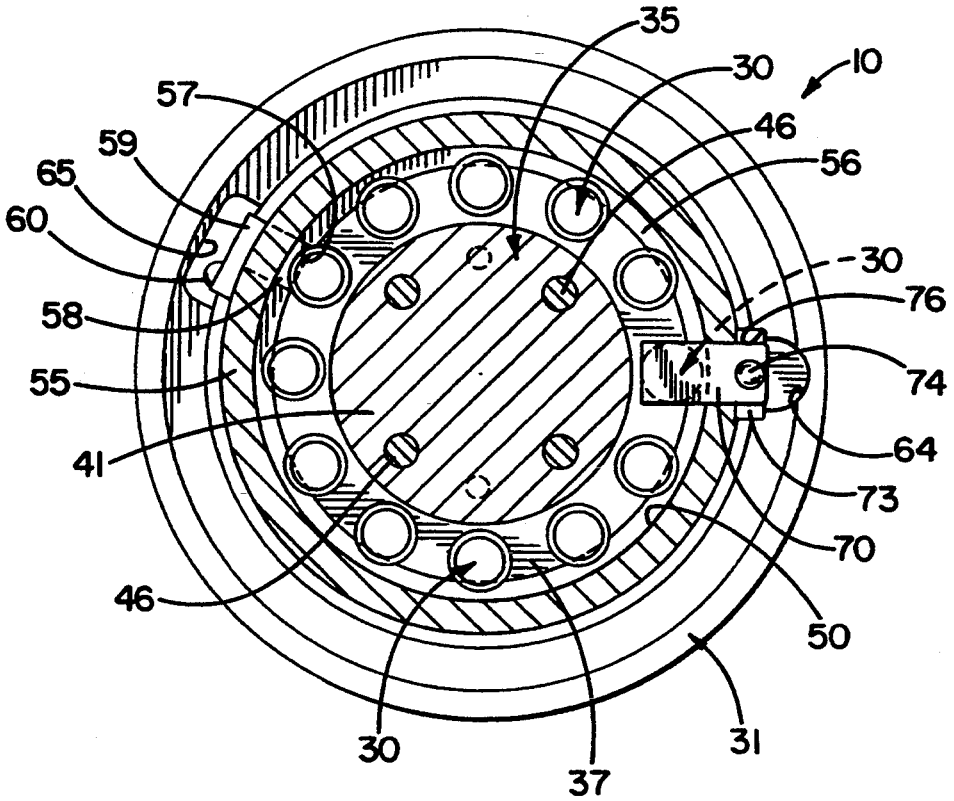
FIG. 3

INDEXABLE MARKING TOOL FOR USE WITH A PUNCH PRESS

BACKGROUND OF THE INVENTION

This invention relates to a marking tool assembly adapted for use with a punch press and adapted to stamp identifying indicia on a workpiece which is processed by the punch press. For example, the marking tool assembly may be used to stamp a part number into the workpiece.

In one type of punch press, a punch is carried on the lower end of a hydraulically actuated ram which is adapted not only to be reciprocated upwardly and downwardly but also to be rotated about a vertical axis. During the downstroke of the ram, the punch coacts with an underlying die to form a hole through the workpiece. By rotating the ram, a non-circular punch may be positioned to form a non-circular hole in a preselected angular orientation in the workpiece.

As the punch moves through its downstroke, a stripper ring moves downwardly into engagement with the workpiece to clamp the workpiece against the die during the punching operation. The punch then moves downwardly through the stripper ring and punches the hole. As the punch is retracted, the stripper ring holds the workpiece downwardly to enable the punch to strip out of the workpiece. Thereafter, the stripper ring is retracted upwardly to permit the workpiece to be repositioned beneath the punch.

Conventionally, the hydraulic actuator for the ram may be preset to effect automatic retraction of the ram when a predetermined downward force is exerted on the punch. As a result, the actuator is protected against overload.

SUMMARY OF THE INVENTION

The aim of the present invention is to provide a new and improved marking tool assembly which takes advantage of the rotary ram to enable a selected one of a plurality of marking punches to be indexed into an active punching position, which takes advantage of the stripper ring to enable the selected punch to stamp a mark into the workpiece during the downstroke of the ram, and which takes advantage of the overload protection of the ram to control the stamping force and to effect automatic retraction of the marking punch assembly when the mark has been punched to a predetermined depth.

These and other objects and advantages of the invention will become more apparent from the following detailed description when taken in conjunction with the accompanying drawings.

BRIEF DESCRIPTION OF THE DRAWINGS

FIG. 2 is an enlarged cross-sectional view taken substantially axially through the marking tool assembly.

FIG. 3 is a cross-section taken substantially along the line 3—3 of FIG. 2.

Figure 1:
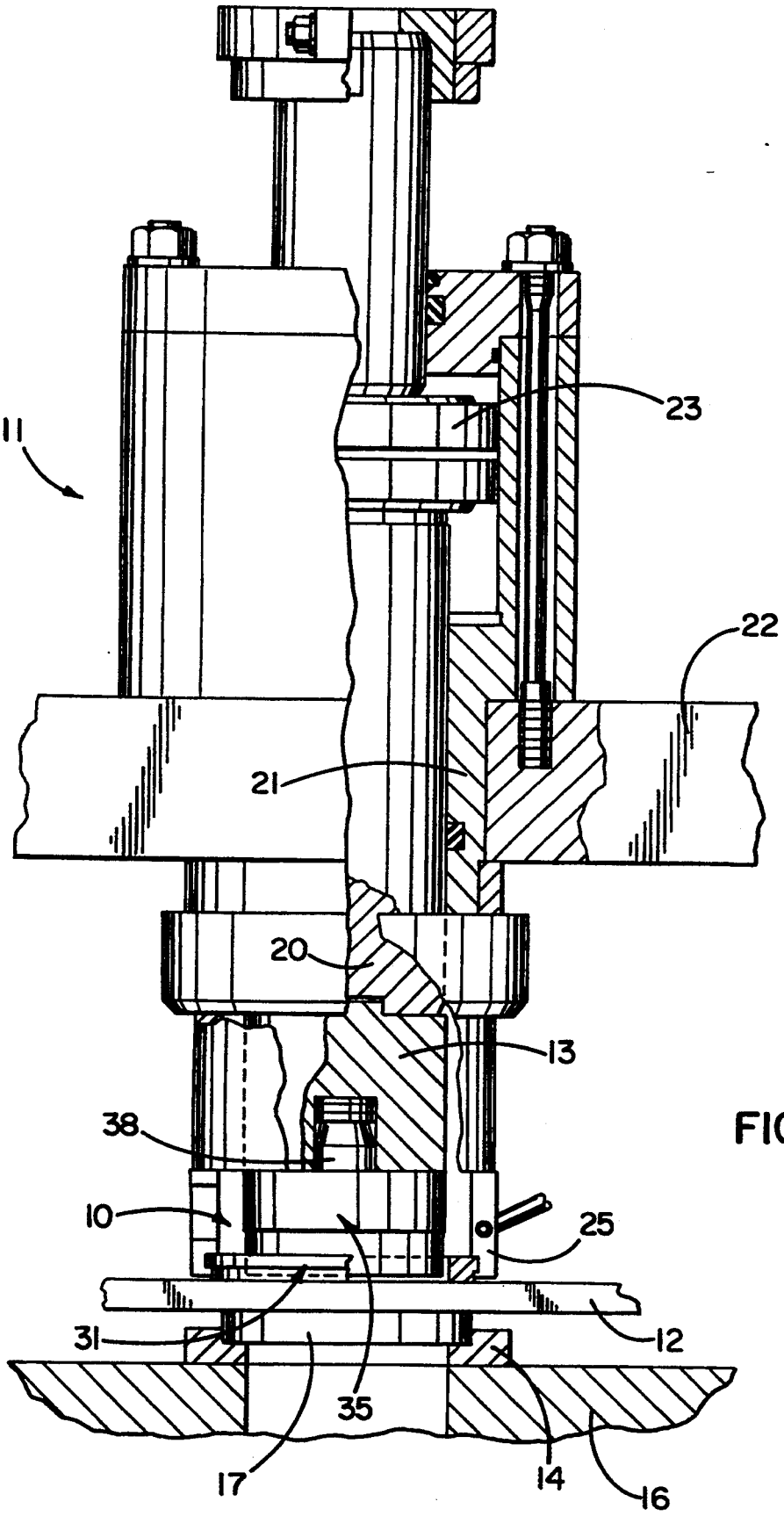
FIG. 1 is a side elevational view of a typical hydraulic punch press equipped with a new and improved marking tool assembly incorporating the unique features of the present invention, certain components being broken away and shown in section.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the marking tool assembly 10 of the present invention has been shown in the drawings in conjunction with a hydraulic punch press 11 which is of well known construction and which is used to punch holes in a generally horizontal sheet metal workpiece 12. The punch press typically includes a punch holder 13 and a die holder 14, the latter being supported on a bed 16 beneath the workpiece. In the present instance, a solid anvil 17 has been shown as installed in the die holder in place of a conventional apertured die.

The punch holder 13 is carried on the lower end of a ram 20 which is adapted to be reciprocated upwardly and downwardly in a cylinder 21 supported on a main frame member 22 of the press 11. A piston 23 attached to the upper end portion of the ram is located in the cylinder and drives the ram downwardly and upwardly when the upper and lower ends, respectively, of the cylinder are pressurized by hydraulic oil. The ram also is adapted to be rotated or indexed about its own axis in a well known manner in order to position a non-circular punch (not shown) in a predetermined angular orientation relative to the workpiece 12. The cylinder 21 is provided with conventional overload protection sensors which effect automatic retraction of the ram 20 when the upward force exerted on the ram exceeds a predetermined magnitude.

Attached to the lower end of the cylinder 21 is a tubular stripper housing 25. When the press 11 is being used for normal punching operations, a stripper on the lower end of the stripper housing engages the upper side of the workpiece 12 so as to clamp the workpiece against an underlying die and cause the punch to strip upwardly out of the workpiece during the upstroke of the ram 20. The stripper housing is adapted to be moved downwardly as the ram moves downwardly and to retract upwardly shortly after the punch strips out of the workpiece.

In addition to punching holes in the workpiece 12, the press 11 also is used to stamp identifying indicia (e.g., a part number) into a workpiece. According to the present invention, provision is made of a unique marking tool 10 which carries several distinct marking punches 30 (FIGS. 2–4) and which utilizes the rotary motion of the ram 20 to enable a selected marking punch to be indexed into an active punching position. During the downstroke of the ram 20, a stripper ring 31 connected to the stripper housing 25 is utilized to cause the selected punch 30 to stamp a character into the workpiece. When sufficient force has been exerted on the punch to adequately mark the workpiece, the ram 20 automatically retracts the marking tool 10.

More specifically, the marking punches are supported by a holder 35 having upper and lower sections 36 and 37 (FIG. 2). The upper section 36 includes a vertically extending shank 38 which is adapted to be telescoped into and secured tightly within the punch holder 13 in order to attach the marking tool 10 securely to the ram 20. A pin 39 projecting upwardly from the upper side of the upper section 36 coacts with the punch holder to establish proper angular orientation of the marking tool relative to the punch holder.

The upper section 36 of the marking tool holder 35 also is formed with a radially outwardly projecting flange 40 adjacent the lower end of the shank 38, the flange having a generally horizontal and downwardly facing surface. Integral with and depending from the flange is a cylindrical block 41.

Figure 4:
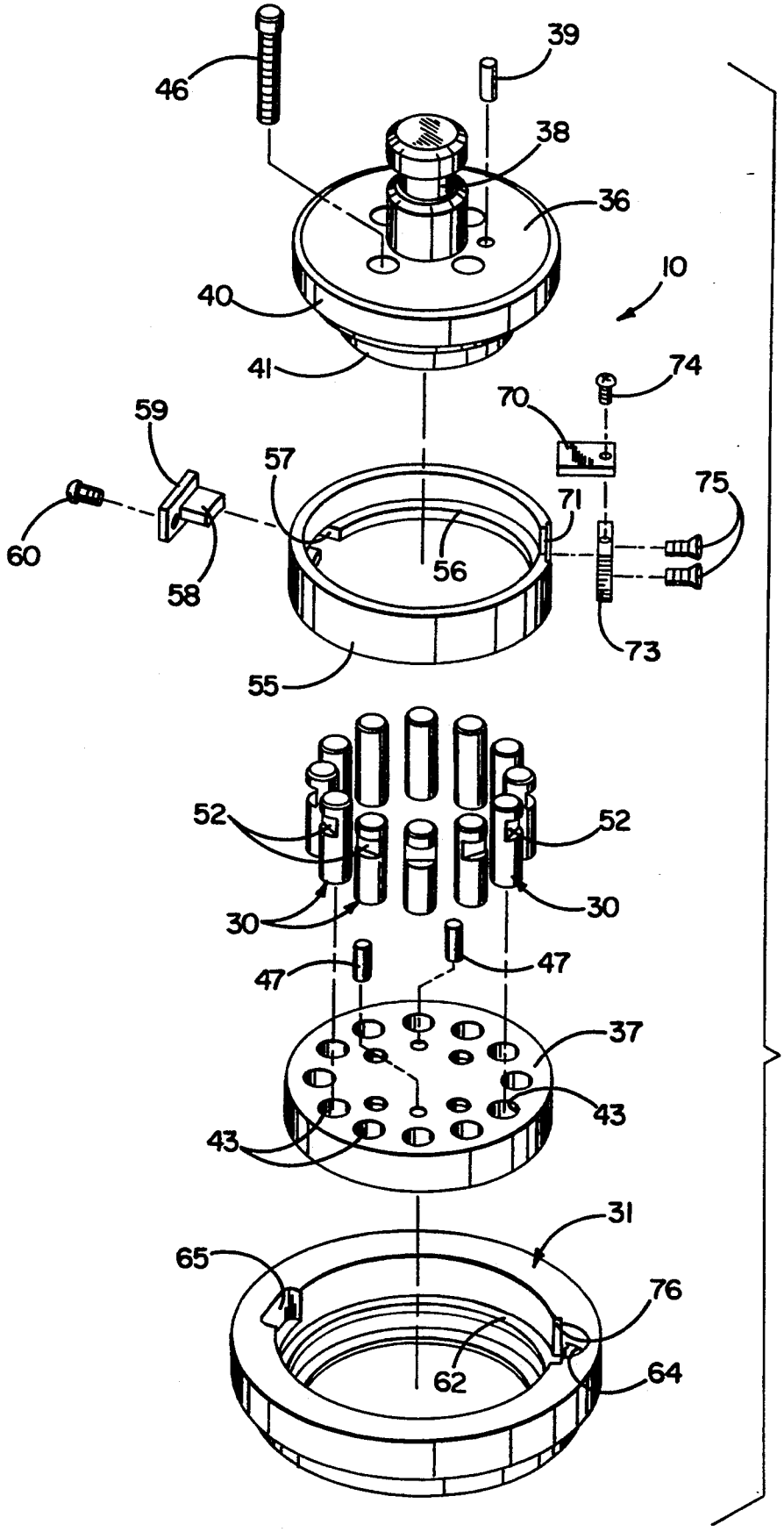
FIG. 4 is an exploded perspective view of the marking tool assembly.

As shown most clearly in FIG. 4, the lower section 37 of the marking tool holder 35 is in the form of a cylindrical disc having a series of vertically extending and angularly spaced holes 43 formed therethrough, the holes being arranged in a circle. Formed integrally with and depending from the disc and located radially inwardly of the holes is a downwardly extending and reduced diameter nose 44 (FIG. 2) having a flat lower surface 45. The upper side of the disc 37 abuts the lower side of the block 41 of the upper holder section 36 and is secured thereto by four angularly spaced screws 46. Two dowel pins 47 (FIG. 4) help locate the disc 37 in a precise angular position relative to the block 41.

An annular chamber 50 (FIG. 2) is defined by the lower side of the flange 40, by the outer side of the block 41 and by the upper side of the disc 37. The marking punches 30 (there herein being twelve such punches) are telescoped slidably in the holes 43 in the disc and their upper end portions are located in the chamber 50. The lower end of each punch is formed with a downwardly protruding and distinctive alpha/-numeric character 51 for stamping the workpiece 12 while the outer periphery of the upper end portion of each punch is formed with an outwardly opening notch 52 (see FIG. 4).

The outer side of the chamber 50 is closed by a retaining ring 55 located between the disc 37 and the flange 40 but sized axially so as to not be clamped between the flange and the disc when the screws 46 are tightened. Formed integrally with and projecting inwardly from the inner periphery of the retainer ring 55 is an annular retaining element or rib 56 (FIG. 4) which projects into the notches 52 in the punches 30 with substantial vertical clearance. The rib 56 is circumferentially continuous except for a short interrupted section which defines a vertically extending notch 57 through the rib. The notch 57 normally is closed by a retaining element in the form of a tongue 58 having substantially the same size and shape as the rib and formed integrally with a plate 59 adapted to be secured releasably to the outer side of the ring 55 by a screw 60. When the plate 59 is in place, the tongue 58 closes the notch 57 and forms a smooth continuation of the rib 56 so as to project into the notches 52 in the punches 30 in the same manner as the rib.

As shown most clearly in FIG. 4, the stripper ring 31 is a sleeve-like member which is formed with an upwardly opening counterbore 62. The stripper ring fits inside of the lower end of the stripper housing 25 and is adapted to be secured rigidly thereto by fasteners (not shown), one of the fasteners projecting upwardly from a generally semi-circular notch 64 formed in the ring. The stripper ring encircles the disc 37 and the retaining ring 55 and is formed with an upwardly opening pocket 65 (FIG. 4) for accommodating the plate 59 and the head of the screw 60.

The marking tool 10 is completed by a striker member 70 which coacts with the flange 40 and the stripper ring 31 to cause a selected one of the punches 30 to stamp indicia into the workpiece 12. Herein, the striker 70 is generally in the form of a horizontal plate which projects radially into the chamber 50 through a slot 71 (FIG. 4) in the upper side of the retaining ring 55, the striker underlying the flange 40. A vertical mounting key 73 is connected to the lower side of the outer end portion of the striker 70 by a screw 74 and is connected to the outer side of the retaining ring 55 by a pair of screws 75. The lower end portion of the key 73 is received for vertical sliding in a correspondingly shaped keyway 76 formed in the inner side of the stripper ring 31 adjacent the inner side of the notch 64.

When the marking tool 10 is retracted upwardly from the workpiece 12, all of the punches 30 are located in lowered positions (as exemplified by the right-hand punch shown in FIG. 2). When the punches are in their lowered positions, their stamping characters 51 project below the lower surface 45 of the nose 44 of the disc 37. The upper ends of the notches 52 of eleven of the punches engage the upper side of the rib 56 to limit downward movement of those punches while downward movement of the remaining punch is limited by virtue of the upper end of its notch 52 engaging the tongue 58. One of the punches, namely, the right-hand punch shown in FIG. 2, is located in an active punching position and, as illustrated, the striker 70 is sandwiched between the upper end of that punch and the lower side of the flange 40 of the upper holder section 36.

As the tool 10 is moved through its downstroke, the stamping characters 51 on the lower ends of all of the punches 30 engage the workpiece 12 (see FIG. 2). Upon such engagement, all of the punches except the punch in the active punching position are, in effect, forced to slide upwardly within the holes 43 in the disc 37, such sliding being permitted by virtue of the vertical clearance between the notches 52 on the one hand and the rib 56 and the tongue 58 on the other hand. In actuality, the punches that are not in the active position simply stop against and rest on the workpiece as the tool 10 continues through its downward stroke and thus, as the nose 44 engages the workpiece, the stamping characters 51 of such punches are disposed substantially in the same plane as the lower surface 45 of the nose and do not penetrate the workpiece.

By virtue of the striker 70, the punch 30 in the active punching position shown at the right in FIG. 2 is prevented from sliding in its respective hole 43 in the disc 37 when the stamping character 51 of that punch engages the workpiece 12. Instead, the striker 70 transmits downward force from the flange 40 to the active punch as the marking tool completes its downstroke and thus the character 51 on the active punch remains below the lower surface 45 of the nose 44 and stamps an identifying mark in the workpiece 12. The anvil 17 prevents the workpiece from flexing beneath the punch during the marking operation. When the tool 10 continues downwardly and the force exerted on the nose reaches a predetermined magnitude, the ram 20 automatically retracts the tool.

By replacing the striker 70 with one of greater or lesser thickness, the depth of penetration of the stamping character 51 into the workpiece 12 may be increased or decreased.

When the ram 20 is rotationally indexed, the disc 37 also is rotated and causes the punches 30 to ride along the rib 56 and the tongue 58 so as to index one punch out of the active marking position beneath the striker 70 and to index another punch into that position thereby to enable a different character to be stamped into the workpiece 12. During rotation of the disc, the key 73 holds the striker 70 and the retaining ring 55 rotationally stationary by virtue of the key interfitting with the keyway 76 in the rotationally fixed stripper ring 31. The key also allows the tool holder 10 to move upwardly and downwardly relative to the stripper ring 31 by virtue of the key sliding vertically in the keyway.

Advantageously, the tongue 58 and the plate 59 define a removable section which enables punches 30 to be installed in and removed from the tool holder 35. When the tongue and the plate are removed from the retaining ring 55 by releasing the screw 60, the notch 57 in the rib 56 is exposed as shown in FIG. 4 and overlies part of the circle defined by the holes 43 in the disc 37. Thus, by indexing the disc, each hole may be brought into vertical alignment with the notch 57 to enable a punch to either be slipped upwardly through the hole and the notch and into the chamber 50 or to enable a punch to be slipped downwardly through the notch and the hole for removal from the holder 35. Once a punch has been inserted through the notch 57 its lower end portion is held manually until the disc 37 is indexed to cause the notch 52 in the punch to move onto the rib 56. After the punches have been installed, the tongue 58 and the plate 59 are re-attached to the ring 55 by the screw 60 so as to captivate the punches in the holes 43 and the chamber 50.

From the foregoing, it will be apparent that the present invention brings to the art a new and improved marking tool assembly 10 in which a selected punch 30 forms an identifying alpha-numeric mark in the workpiece 12 by virtue of the striker 70 causing only the selected punch to be active during the downstroke of the tool. The stripper ring 31 holds both the striker and the retaining ring rotationally stationary so as to enable the striker to actuate the selected punch and to enable the retaining ring to guide the punches to a position beneath the striker when the ram 20 is indexed.

We claim:

1. A marking tool assembly for stamping indicia on a workpiece, said tool assembly comprising a holder adapted to be indexed about a vertical axis and adapted to be reciprocated upwardly and downwardly along said axis, a stripper ring encircling said holder and fixed against rotation relative to said holder, said holder moving vertically relative to said stripper ring when said holder is reciprocated upwardly and downwardly, said holder having a lower end surface disposed in a generally horizontal plane and engageable with the workpiece when said holder is shifted downwardly through an active stroke, a plurality of marking punches mounted for up and down sliding in said holder and each having an indicia-forming character on its lower end, said punches being spaced angularly around said axis and being located radially outwardly of said lower end surface of said holder, successive punches being indexed to a punching position when said holder is indexed through successive steps about said axis whereby any selected punch may be located in said punching position, the lower ends of all of said punches being positioned in said holder to project downwardly and substantially equi-distantly below the lower end surface of said holder and to engage the workpiece just prior to engagement of the lower end surface of said holder with said workpiece when said holder is shifted downwardly through its active stroke, all punches except the selected punch in said punching position sliding idly upwardly relative to said holder when the lower ends of such punches engage the workpiece and as said holder continues downwardly through its active stroke, and means connected to said stripper ring and preventing the selected punch in said punching position from sliding upwardly relative to the holder whereby the lower end of said selected punch stamps indicia on the workpiece as the holder completes its active stroke and as the lower end surface of the holder engages the workpiece.

2. A marking tool assembly as defined in claim 1 in which said means comprise a striker member projecting into said holder and overlying the upper end of the selected punch in said punching position, said holder having a horizontal surface engageable with said striker member, said striker member transmitting force from said horizontal surface to said selected punch during the active stroke of said holder.

3. A marking tool assembly as defined in claim 1 further including a retaining ring fixed against rotation relative to said stripper ring, there being a notch formed in one side of each of said punches, said retaining ring having a retaining element projecting into said notches with vertical clearance whereby said retaining element suspends said punches vertically and permits indexing of said punches while allowing said punches to slide vertically in said holder.

4. A marking tool assembly as defined in claim 3 in which said retaining ring includes a detachable section with a retaining element, and means securing said detachable section to said holder and selectively releasable to permit said detachable section to be removed from said holder thereby to create a gap and permit punches to be moved downwardly out of said holder through said gap.

5. A marking tool assembly as defined in claim 3 in which said means comprise a striker member projecting into said holder and overlying the upper end of the selected punch in said punching position, said holder having a horizontal surface engageable with said striker member, said striker member transmitting force from said horizontal surface to said selected punch during the active stroke of said holder.

6. A marking tool assembly as defined in claim 5 further including means keying said retaining ring and said striker member against rotation relative to said stripper ring while permitting said retaining ring and said striker member to move upwardly and downwardly relative to said stripper ring.

7. A marking tool assembly for stamping indicia on a workpiece, said tool assembly comprising a holder adapted to be indexed about a vertical axis and adapted to be reciprocated upwardly and downwardly along said axis, a stripper ring encircling said holder and fixed against rotation relative to the holder, said holder moving vertically relative to said stripper ring when said holder is reciprocated upwardly and downwardly, said holder comprising upper and lower sections, an annular chamber located between said sections and having a generally horizontal downwardly facing surface, said lower section of said holder having a lower end surface disposed in a generally horizontal plane and engageable with the workpiece when said holder is shifted downwardly through an active stroke, a plurality of marking punches mounted for up and down sliding in said lower section of said holder and having upper end portions located in said chamber, each of said punches having an indicia-forming character on its lower end, said punches being spaced angularly around said axis and being located radially outwardly of said lower end surface of said holder, successive punches being indexed to a punching position when said holder is indexed through successive steps about said axis whereby any selected punch may be located in said punching position, means fixed against rotation relative to said stripper ring and located in said chamber, said means limiting downward movement of said punches in said holder while allowing said punches to slide vertically in said holder and to be indexed to said punching position, the lower ends of said punches projecting downwardly below the lower end surface of said holder and engaging the workpiece just prior to engagement of the lower end surface of said holder with said workpiece when said holder is shifted downwardly through its active stroke, all punches except the selected punch in said punching position sliding idly upwardly relative to said holder when the lower ends of such punches engage the workpiece and as said holder continues downwardly through its active stroke, and means connected to said stripper ring and coacting with said downwardly facing surface of said chamber to prevent the selected punch in said punching position from sliding upwardly relative to the holder whereby the lower end of said selected punch stamps indicia on the workpiece as the holder completes its active stroke and as the lower end surface of the holder engages the workpiece.

* * * * *